US005823797A

United States Patent [19]

Sugiyama

[11] Patent Number: 5,823,797

[45] Date of Patent: Oct. 20, 1998

[54] CONNECTOR-COMBINED UNIT CASE, METHOD OF MOLDING THEREOF, AND MOLD FOR MOLDING THEREOF

[75] Inventor: Norio Sugiyama, Haibara-gun, Japan

[73] Assignee: Yazaki Corporation, Tokyo, Japan

[21] Appl. No.: 790,298

[22] Filed: Jan. 31, 1997

[30] Foreign Application Priority Data

Feb. 2, 1996 [JP] Japan ..... 8-017555

[51] Int. Cl.[6] ..... H01R 9/09

[52] U.S. Cl. ..... 439/76.1; 439/66; 29/883

[58] Field of Search ..... 439/34, 76.1, 66, 439/736; 29/854, 855, 856, 883

[56] References Cited

U.S. PATENT DOCUMENTS 5,382,169 1/1995 Bailey et al. ..... 439/66 X

*Primary Examiner*—Khiem Nguyen

*Attorney, Agent, or Firm*—Armstrong, Westerman, Hattori, McLeland & Naughton

[57] ABSTRACT

A connector-combined unit case comprises a unit case portion for containing electric components; a connector portion for connecting the unit case to a mating connector, said unit case portion and said connector portion each being sealable against external air; a connection portion integrally connecting said unit case portion and said connector portion; and conductors embedded in layers in said connection portion, each extending to connect said unit case portion with said connector portion. This unit case does not require an apt-to-fail, costly and complex slide core-equipped mold, is free from troubles such as a short-circuit, corrosion of internal components and the like, enables easy coupling and decoupling of a mating connector, and does not require the mating connector to be changed in shape.

8 Claims, 9 Drawing Sheets

CONNECTOR-COMBINED UNIT CASE, METHOD OF MOLDING THEREOF, AND MOLD FOR MOLDING THEREOF

BACKGROUND OF THE INVENTION

1. Field of the Invention

This invention relates to a connector-combined unit case having a unit case portion for accommodation therein of electric components and a connector portion which connects the unit case with a mating connector, and also to a method of molding the unit case, and a mold for molding the unit case.

2. Description of the Related Art

An example of a conventional connector-combined unit case B is shown in section in FIG. 8, which is comprised of a unit case portion 1' and a male connector portion 2'. Not-shown various electric components such as an electronic circuit are contained in the interior 1*a*' of the unit case portion 1'. The connector portion 2' is of a waterproof structure adapted to become airtight on connection with a mating connector, and has therein terminals 3*a*' and 4*a*' which are integral parts of respective busbars 3' and 4' and serve to make electric connections with a mating connector. These busbars 3' and 4' are integrally embedded as inserts in layers in the molded material constituting a unit case bottom 1*b*', and integrally provided with contacts 3*b*' and 4*b*' for electric connection with the various electric components in the unit case interior 1*a*' and contacts 3*c*' and 4*c*' extended at the rear surface side of the unit case bottom 1*b*'.

This unit case B with a connector is of a structure which becomes airtight during its use. In other words, grooves 1*c*' are provided at longitudinally spaced positions on the rear surface of the unit case bottom 1*b*' and on end surfaces of the longitudinally opposite walls of the unit case, each for receiving an O-ring (not shown) which makes the unit case airtight when the unit case is mounted, i.e., when the unit case is at the side of its bottom 1*b*' fixed on a wall surface and at the opposite side covered with a lid (not shown). These O-rings prevent the unit case after mounted from being penetrated from outside with a corrosive gas, water or the like.

To mold such a connector-combined unit case having a plurality of busbars as inserts, the busbars are at their terminals 3*a*' and 4*a*' held in position by a molding die and at the same time held inside the cavity of the mold by die-carried busbar-holding pins, so as to prevent the mutual contact of the busbars inside the molded product and a short-circuit therebetween. After completion of the molding, such busbar-holding pins leave corresponding pin holes 5' in the molded product as shown in FIG. 8.

Such a connector-combined unit case is excellent, capable of being sealed against water (air) when mounted as mentioned above, but has a drawback that, when mounted on a wall surface, the coupling and decoupling operations of a mating connector to and from the unit case are troublesome, since the coupling and decoupling operations are effected in a side direction of the unit case (in a direction parallel to the wall surface). Besides, such a unit case, when mounted, requires a space aside within which the mating connector is moved to be coupled and decoupled.

In addition, because of its structure in which the connector portion forms an undercut, the unit case requires for its molding a mold with a slide core. Further, a plurality of slide cores each having a complicated shape and structure are in many cases required for forming this connector portion, since the connector portion needs to have a complex shape for its functions such as positioning, falling-off prevention and waterproofing. As a result, there has been a drawback that the mold becomes costly, is easy to cause failures, and has a low product yield and productivity, resulting in the high production cost of the unit case.

Here, it may be deemed possible to solve the above-mentioned problems of the coupling space and undercut by providing a connector portion to have a coupling direction which is the same as the opening direction of the unit case. In this case, however, there are conventionally practically no means which prevent the mutual contact of busbars inside the cavity during molding, resulting in the connector portion and unit case portion requiring to be formed in close contact with each other. Consequently, the shape of the connector portion is limited to be female, which in turn requires the mating connector to be changed in shape, i.e., to a male connector, resulting in the cost increased and in difficulty in obtaining sufficient airtightness due to limitations to the shape.

If, as means to prevent the mutual contact of busbars inside the cavity during molding, such busbar-holding pins as used to hold the busbars in place in the unit case portion during molding are for example applied, these pins leave pin holes in the molded product which expose the internal busbars to the outside. These pin holes are formed at an area outside the range covered by the O-ring grooves and are likely to not only cause a short circuit, but also allow a corrosive gas or moisture to penetrate into the case and connector through the pin holes and small gaps inevitably made between the busbars and the case by a difference in their materials and corrode the inside to cause a failure. Such externally opened pin holes may possibly be covered with caps or filled with an adhesive, which, however, is not practical, requiring labor hours and in particular being unreliable for a long-term use under the environment of vibrations as in an automobile and the like.

SUMMARY OF THE INVENTION

This invention has been accomplished to overcome the above drawbacks and an object of this invention is to provide a connector-combined unit case having a waterproof structure, which does not require an apt-to-fail, costly and complex slide core-equipped mold, is free from troubles such as a short-circuit, corrosion of internal components and the like, enables easy coupling and decoupling of a mating connector without requiring a coupling and decoupling space by the side of the unit case, and does not require the mating connector to be changed in shape. Another object of this invention is to provide a method of molding the unit as mentioned above. A further object of this invention is to provide a mold for molding the same.

In order to attain the object, according to an aspect of this invention, there is provided a connector-combined unit case comprising: a unit case portion for containing electric components therein; a connector portion for connecting the unit case to a mating connector, the unit case portion and the connector portion each being sealable against external air; a connection portion integrally connecting the unit case portion and the connector portion; and conductor means embedded in the connection portion to be unexposed to external air, the conductor means extending to connect an interior of the unit case portion with the connector portion.

According to another aspect of this invention, there is provided a method of molding a connector-combined unit case as claimed in claim 1, comprising the steps of: setting conductor means inside dies before the dies are clamped; holding the conductor means in place with preliminary holding means before resin is introduced into the dies; retracting the holding means during the introduction of resin into the dies to release the hold of the conductor means; and filling an empty space formed by the retraction of the preliminary holding means with resin.

According to a further aspect of this invention, there is provided a mold for molding a connector-combined unit case as claimed in claim 1, comprising: preliminary holding means for holding conductor means in place before resin is introduced into dies of the mold, the holding means being retracted during the introduction of resin into the dies to release the hold of the conductor means.

The above and other objects, features and advantages of this invention will become apparent from the following description and the appended claims, taken in conjunction with the accompanying drawings in which like parts or elements are denoted by like reference characters.

DESCRIPTION OF THE PREFERRED EMBODIMENTS

Embodiments of this invention will now be described with reference to the attached drawings.

While in these embodiments, busbars are shown to be arranged in two layers in the unit case, this application is also applicable to the case where busbars are arranged in three or more layers.

Figure 1:
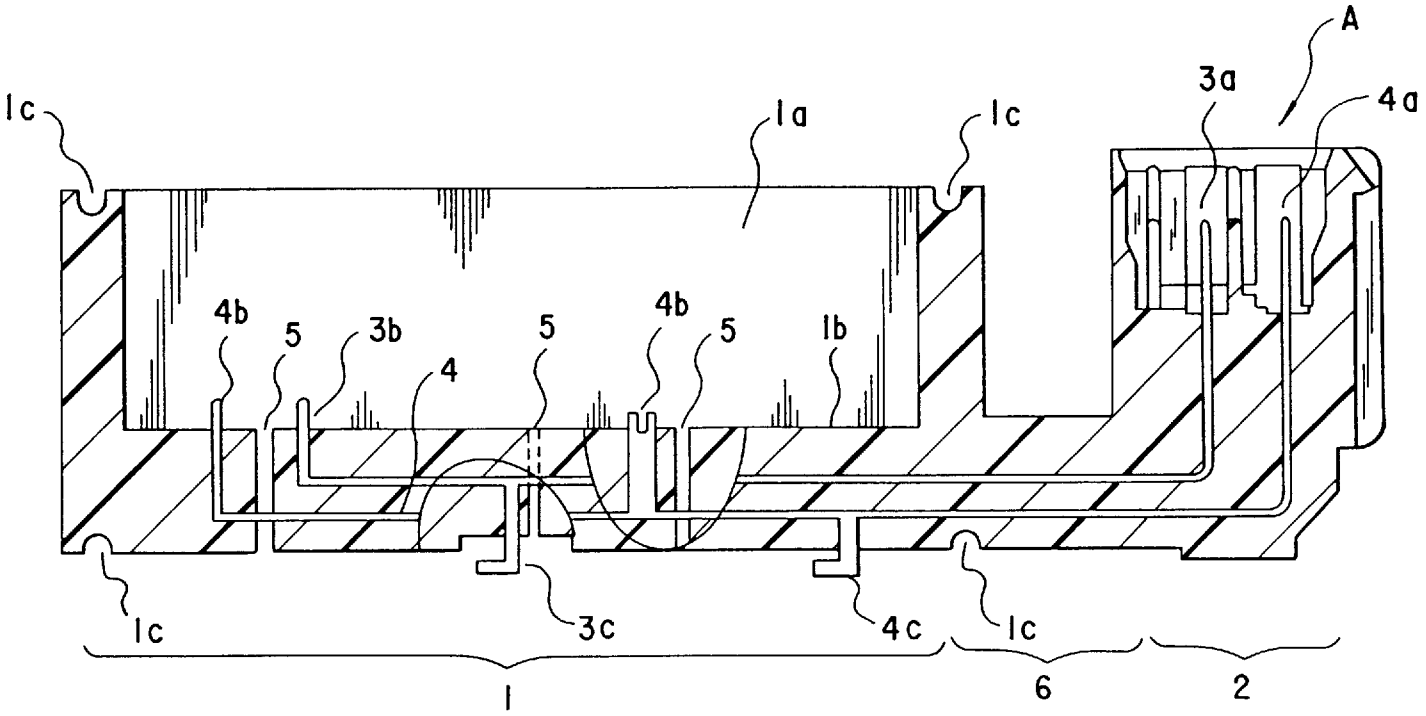
FIG. 1 is a sectional view of a connector-combined unit case according to one embodiment of this invention.

FIG. 1 is a sectional view of a connector-combined unit case A (terminal case for an automotive antilock braking system) according to one embodiment of this invention.

This unit case A is comprised of a unit case portion 1 in the interior 1*a* of which are accommodated various electric components such as an electric circuit, a connector portion 2, and a connection portion 6 that connects these portions 1 and 2. The connector portion 2 serves as a connector of a waterproof structure adapted to become airtight on connection with a mating connector, and has inside thereof terminals 3*a* and 4*a* for electric connection with the mating connector, which are integral with busbars 3 and 4, respectively. Busbars 3 and 4 are embedded as inserts in two spaced layers in the molded material constituting a unit case bottom 1*b*, and integrally provided with respective contacts 3*b* and 4*b* for electric connection with the various electric components contained in the unit case interior 1*a* and respective contacts 3*c* and 4*c* provided on the rear surface side of the unit case bottom 1*b*.

The busbars, disposed in spaced layers as mentioned above, can provide a multiplicity of branch circuits without the fear of causing a short-circuit therebetween.

This connector-combined unit case A is of a structure adapted to become airtight when mounted. In other words, at two longitudinally spaced positions on the rear surface of its bottom 1*b* and on end surfaces of its longitudinally opposite walls, grooves 1*c* are provided, each for receipt therein of an O-ring so that the unit case 1 becomes airtight when fixed at the side of its bottom 1*b* to a wall surface and covered at the opposite side with a lid (not shown). Thus, in use, an external corrosive gas, water or the like is prevented from entering the unit case.

To mold the connector-combined unit case A having a plurality of busbars as inserts, the busbars 3 and 4 are held in position during molding by a die and at the same time held by die-carries busbar-holding pins so as to prevent contact of the busbars inside the molded product and a short-circuit therebetween. The busbar-holding pins leave pin holes 5 in the product as shown in FIG. 1.

The connection portion 6 of the connector-combined unit case A serves to provide the freedom to select the coupling direction of the connector portion 2 and not to restrict the shape of the mating connector to be coupled to the connection portion 2. In other words, due to the connection portion 2, the mating connector may be of a male or female type, and the freedom in designing the mating connector is increased and the necessity of changing the design of the mating connector is eliminated, making it possible to use a versatile connector. Consequently, an improvement in airtightness between the connectors coupled can be made.

Further, by providing the connector portion 2 to have a coupling direction which is the same as the opening direction of the unit case 1 as shown in FIG. 1, the undercut formation of the connector portion 2 is avoided, thereby making it unnecessary to use a mold with a slide core which is costly, complex and apt to fail. Besides, the coupling of a mating connector to the connector portion is facilitated, and the space required aside the unit case A on a wall surface for moving the mating connector into and out of coupling with the connector portion becomes unnecessary.

With such a structure employed, a complex shape can be imparted to the connector portion by adjusting the parting line of the dies, which complex shape is required for the functions of the connector portion such as the positioning at the time of mounting, prevention of disengagement and waterproofing.

A plurality of busbars (busbars 3 and 4 in FIG. 1) are arranged in layers in the connection portion 6. It is to be noted that, in this area which is out of the range covered by the O-rings, die-carried busbar-holding pins cannot be used to hold these busbars in place during molding. In other words, the use of the holding pins leaves pin holes in the product, which open to the outside in this area of the connection portion 6. Consequently, a fear arises that water enters through the pin holes to cause a short-circuit, or a corrosive gas, moisture or the like penetrates inside the unit case portion 1 and/or connector portion 2 through the pin holes and small gaps inevitably made between the busbars and the resin due to the material difference to corrode the internal components and their cotacts.

An example of a molding method and of a mold for solving such problem will now be described with reference to FIGS. 2 to 7. These figures show in sequence the model of the mold in section in each step of the molding (only essential portions including the connector portion and connection portion) and some of its portions in enlarged scale.

Figure 2A:
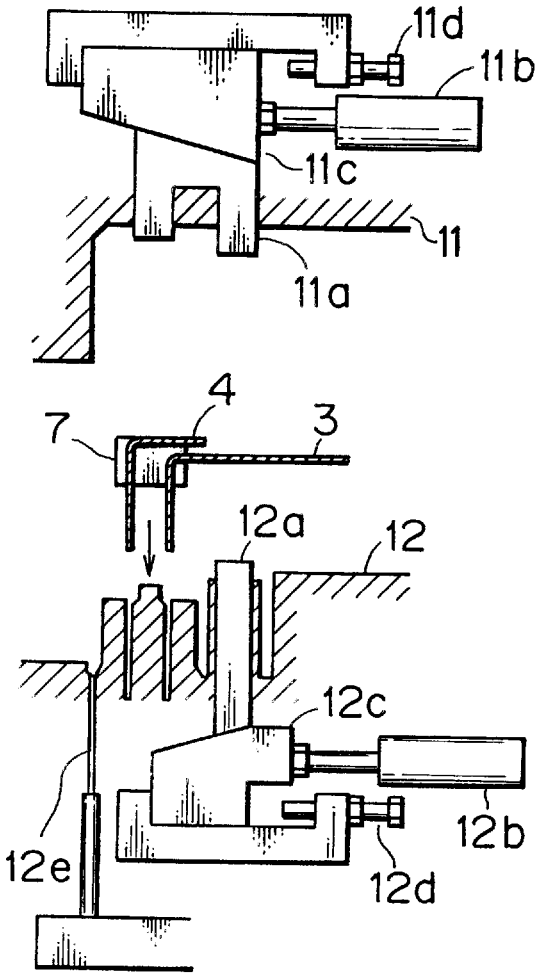
FIG. 2A is a sectional view of a model of a mold used to mold the connector-combined unit case according to this invention.
Figure 2B:
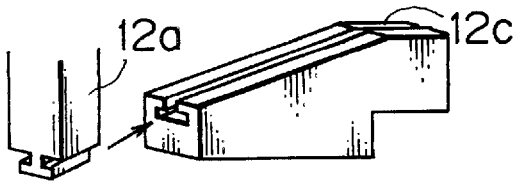
FIG. 2B is a view of a cam mechanism used in molding the unit case as in FIG. 2A.
Figure 2C:
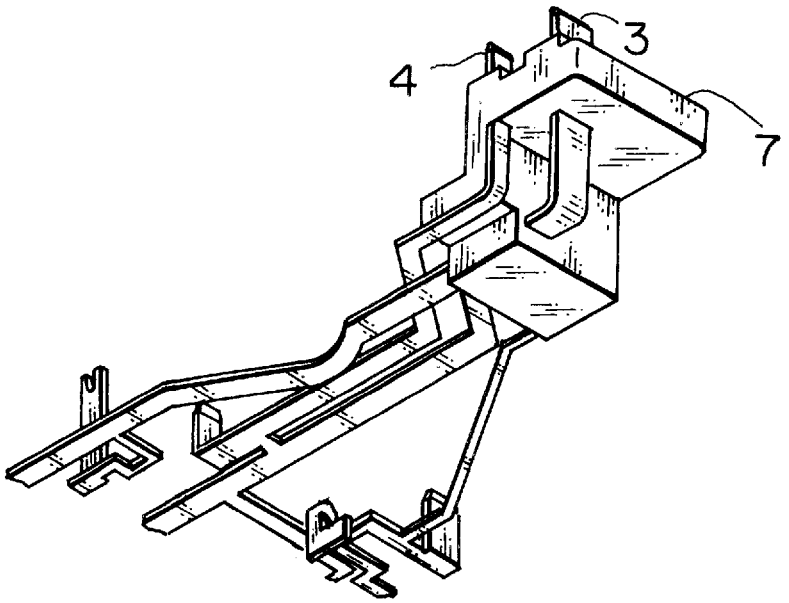
FIG. 2C is a perspective view of a plurality of conductors preliminarily locked relative to each other with an auxiliary means of insulating material to be set inside the mold.

The mold shown in section in FIG. 2A is comprised of an upper die 11 and a lower die 12. The upper die 11 is provided with an upper core 11*a*, an upper air cylinder 11*b*, a cam mechanism 11*c* and an upper adjusting mean 11*d*, while the lower die 12 is provided with a lower core 12*a*, a lower air cylinder 12*b*, a cam mechanism 12*c*, a lower adjusting means 12*d* and a product ejecting pin 12*e*.

The upper core 11*a* and the lower core 12*a* cooperate with each other to provide preliminary holding means and are each movable into and retractable from the cavity defined between the upper and lower dies by the respective upper and lower air cylinders 11*b* and 12*b* and cam mechanisms 11*c* and 12*c*. In other words, the advancement of each cylinder shaft causes the individual core to move into the cavity via the respective cam mechanism, and the retraction of each cylinder shaft causes the individual core to retract from the cavity via the respective cam mechanism. (The lower cam mechanism is partially shown in perspective in FIG. 1B, with the lower core 12*a* shown separated.) The advancement and retraction length of each core is adjustable by means of the respective adjusting means 11*d*, 12*d*. The product ejecting pin 12*e* is for ejecting the product from the die after completion of the molding and is coupled to a die opening and closing mechanism (not shown) to be driven during the opening process of the dies to eject the product.

Insert-forming busbars 3 and 4 are arranged inside the dies. For this purpose, if the busbars are assembled as a set by means of a hold connector 7 as shown in FIG. 2A, their mounting will be facilitated and mounting errors will be prevented. The hold connector 7 also serves to keep the busbars separated from each other. The hold connector 7 is of an insulating material except some special cases, which material is preferably the same as that for the connector-combined unit case so that it becomes integral with the resin later injected to mold the unit case. In this way, post-molding strains can be excluded from the product. Busbars 3 and 4 held by the hold connector 7 are shown in partial perspective in FIG. 2C.

Figure 3:
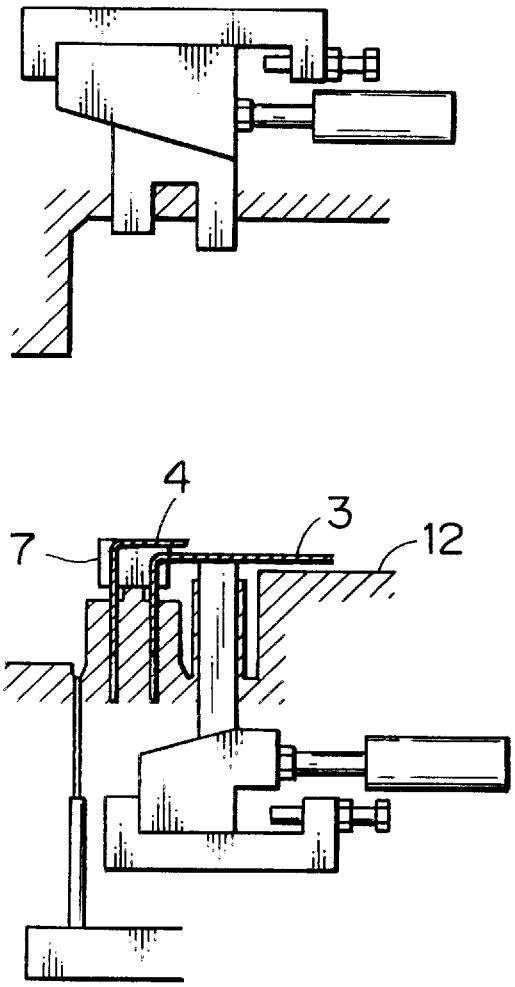
FIG. 3 is a sectional view of the mold model showing the first step of molding according to this invention where busbars are set inside the mold.

FIG. 3 shows the hold connector 7 and busbars 3 and 4 set in place in the lower die 12.

Figure 4A:
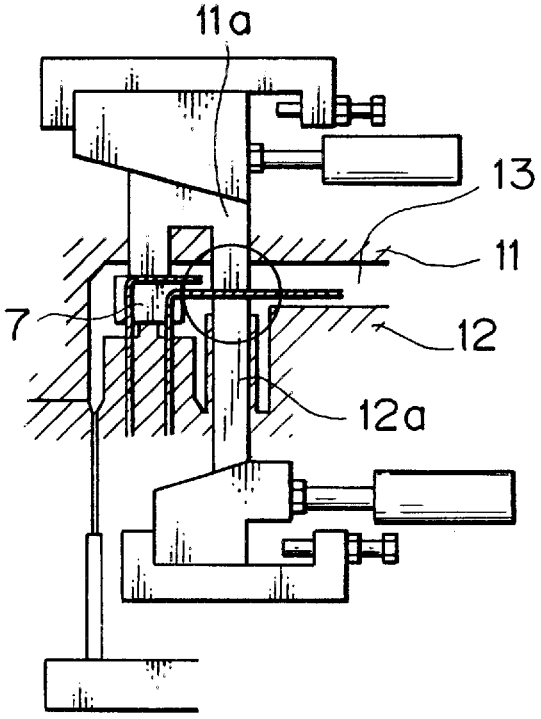
FIG. 4A is a sectional view of the mold model showing the second step of molding according to this invention where dies of the mold are clamped.
Figure 4B:
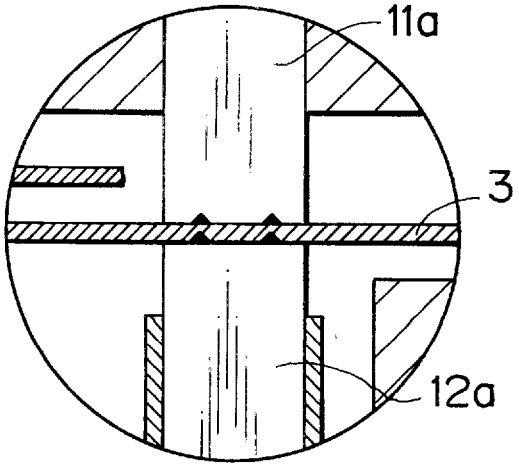
FIG. 4B is a partial enlarged view of FIG. 4A.

FIG. 4A shows the upper and lower dies 11 and 12 clamped to form the cavity 13, at which the busbar 3 is held between the upper and lower cores 11*a* and 12*a* moved into the cavity. (FIG. 4B is an enlarged view of the portion encircled in FIG. 4A.) The busbar 4 is held between the upper core 11*a* and the hold connector 7. Into the cavity 13 is then introduced resin which also serves to hold the busbars in place as mentioned above to prevent their displacement and contacting with each other.

Figure 5A:
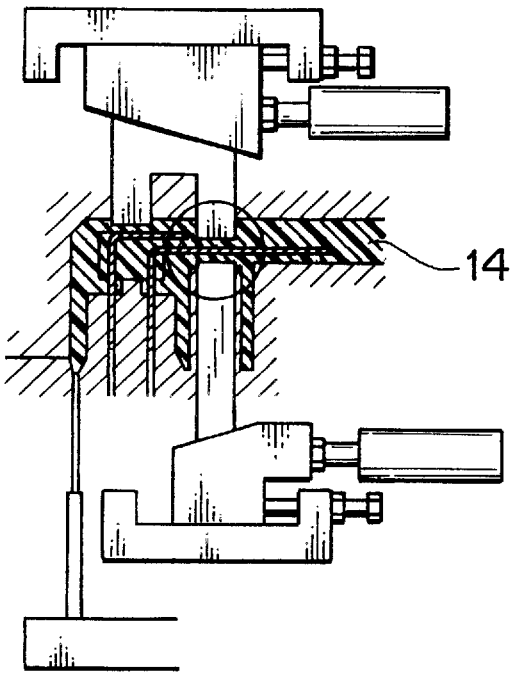
FIG. 5A is a sectional view of the mold model showing the third step of molding according to this invention where resin is introduced into the cavity of the mold and the hold of the busbars is released.
Figure 5B:
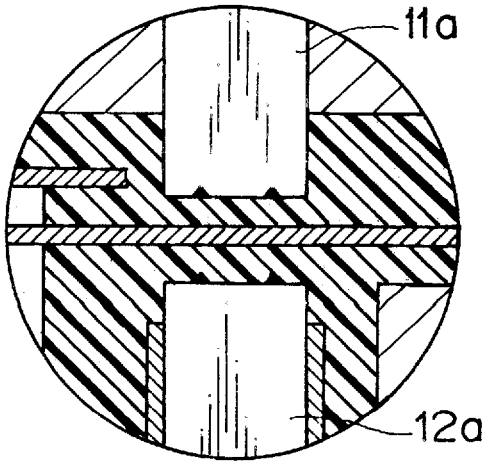
FIG. 5B is a partial enlarged view of FIG. 5A.

FIG. 5A shows the state immediately before the completion of the resin introduction. In this instance, the hold of the busbar by the cores 11*a* and 12*a* is released as best shown in partial enlargement in FIG. 5B. The upper and lower cores 11*a* and 12*a* are retracted to release the hold of the busbar, and the empty spaces made by the retraction of the cores are filled with the resin introduced thereafter and before the completion of the resin introduction, thereby to prevent the internal busbars from being exposed. The timing of the core retraction needs to be suitably adjusted because if it is too early, the busbar will be released at a time when the flow of the resin is still large to cause its displacement, while on the other hand if too late, the resin will not be introduced into the empty spaces made by the retraction of the cores, resulting in the exposure of the busbars to the outside and poor airtightness (waterproofness).

As mentioned above, if the material for the hold connector 7 is the same as the resin introduced into the cavity, a product is obtained which is faborable, free of cracks and the like.

Figure 6A:
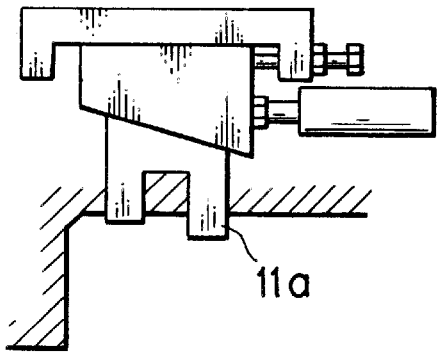
FIG. 6A is a sectional view of the mold model showing the fourth step of molding according to this invention where the clamp of the dies is released.
Figure 6A:
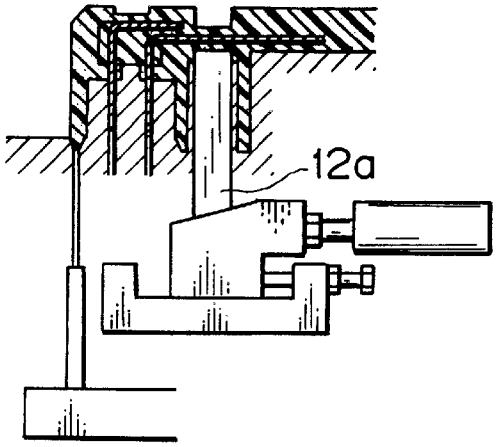
Figure 6B:
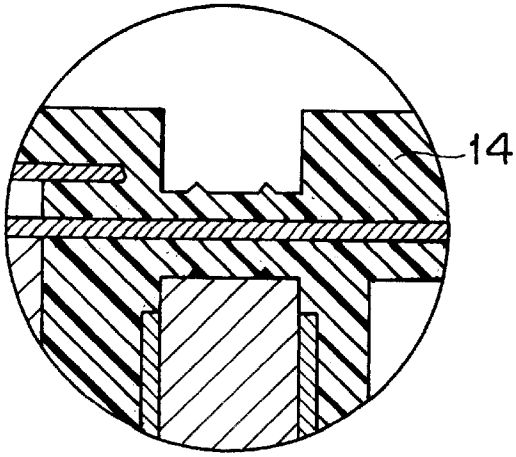
FIG. 6B is a partial enlarged view of FIG. 6A.
Figure 7:
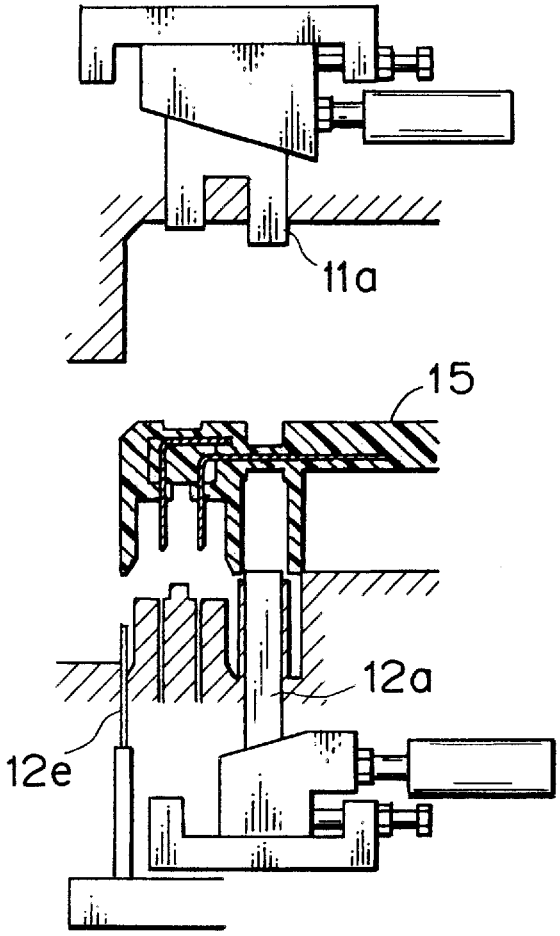
FIG. 7 is a sectional view of the mold model showing the final step of molding according to this invention where the product is removed from the mold.
Figure 8:
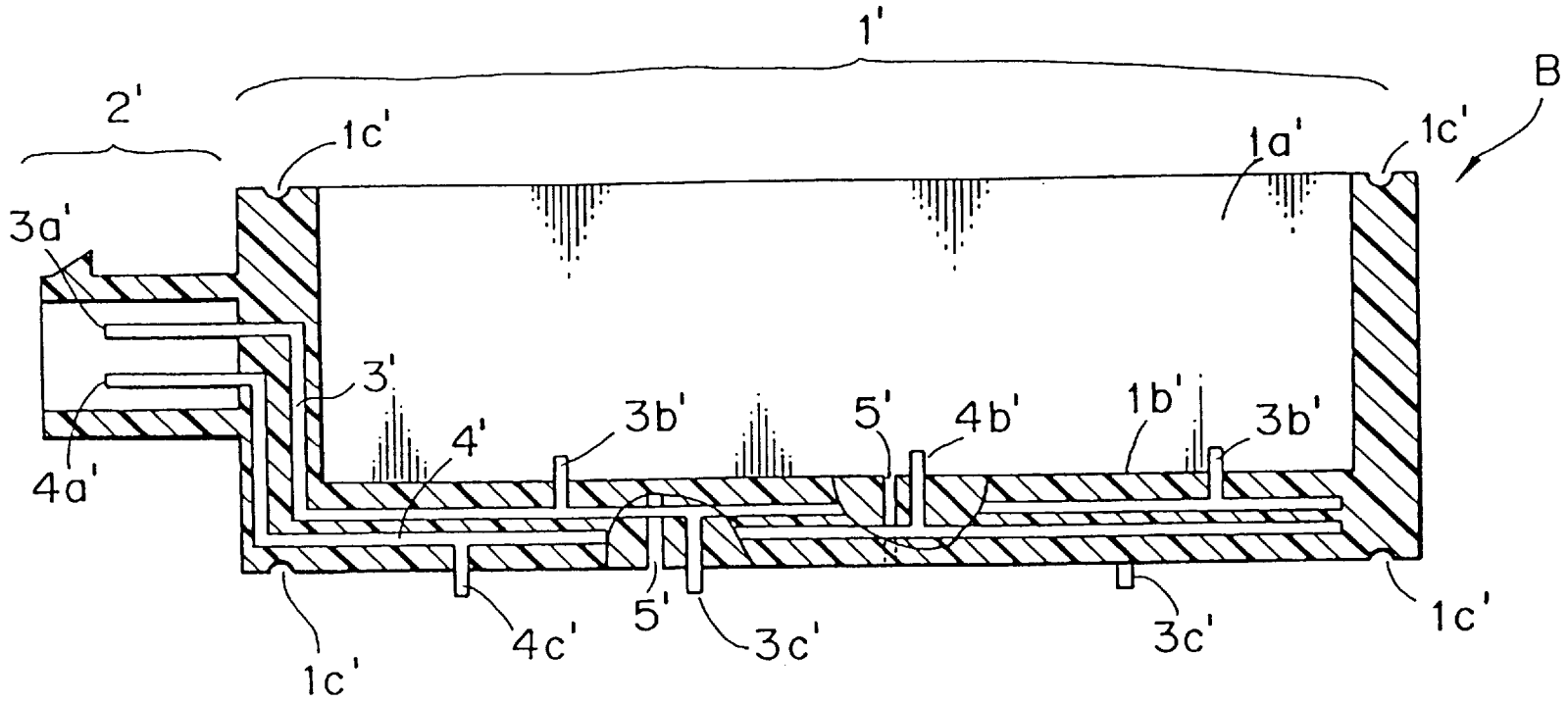
FIG. 8 PRIOR ART
FIG. 8 is a sectional view of a conventional connector-combined unit case.

FIG. 6A shows the state where the clamp is released and FIG. 6B is a partial enlarged view of FIG. 6A. FIG. 7 shows the final step where the product ejecting pin 12*e* projects to eject the product 15 from the die and obtain the connector-combined unit case according to this invention.

The method as described above is widely applicable to the production of not only a connector-combined unit case, but also various electric devices such as an electric junction box, switching case and the like, since the above method provides a molded product with an electric insert reliably insulated from the outside only by giving very simple structures to the upper and lower dies.

Having now fully described the invention, it will be apparent to one of ordinary skill in the art that many changes and modifications can be made thereto without departing from the spirit and scope of the invention as set forth herein.

What is claimed is:

1. A connector-combined unit case molded in one-piece comprising:

a unit case portion for containing electric components therein;

a connector portion for connecting said unit case to a mating connector, said connector portion being sealable against external air when coupled to said mating connector;

a connection portion connecting said unit case portion and said connector portion;

conductor means embedded as inserts during molding and extending to connect an interior of said unit case portion with said connector portion, said unit case portion having holes through which said conductor means are exposed and which are formed by holding means used to hold said conductor means in position during molding, said connection portion having no such holes;

grooves are provided at opposite sides of said unit case portion for receipt therein of means for sealing said unit case portion against external air; and a hollow space located above said connection portion and separating said unit case portion from said connector portion so that terminals at an end of said connector portion are easily accessible for connection to said mating connector.

2. The unit case according to claim 1, wherein said conductor means comprises a plurality of conductors in spaced layers in said connection portion, each extending to connect said interior of said unit case portion with said connector portion.

3. The unit case according to claim 1, wherein said unit case portion, for containing electric components therein, opens in a same direction as a coupling direction of said connector portion to said mating connector.

4. A method of molding a connector-combined unit case, comprising the steps of:

providing a unit case portion for containing electric components therein, a connector portion for connecting said unit case to a mating connector, said connector portion being sealable against external air when coupled to said mating connector, a connection portion connecting said unit case portion and said connector portion, conductor means embedded as inserts during molding and extending to connect an interior of said unit case portion with said connector portion, said unit case portion having holes through which said conductor means are exposed and which are formed by holding means used to hold said conductor means in position during molding, said connection portion having no such holes, grooves are provided at opposite sides of said unit case portion for receipt therein of means for sealing said unit case portion against external air, and a hollow space located above said connection portion and separating said unit case portion from said connector portion so that terminals at an end of said connector portion are easily accessible for connection to said mating connector;

setting conductor means inside dies before the dies are clamped;

holding said conductor means in place with preliminary holding means before resin is introduced into said dies;

retracting said preliminary holding means while said resin is being introduced into said dies to release the hold of said conductor means; and filling an empty space formed by said step of retracting said preliminary holding means with resin.

5. The method according to claim 4, wherein said conductor means comprises a plurality of conductors set in spaced layers to be embedded in molded material.

6. The method according to claim 5, wherein said plurality of conductors are preassembled as a set in a spaced manner with an auxiliary means of insulating material to be set inside said dies.

7. The method according to claim 6, wherein said auxiliary means is formed from a similar resin as that for forming said unit case.

8. A mold for molding a connector-combined unit case, said mold and connector-combined unit case in combination comprising:

providing a unit case portion for containing electric components therein, a connector portion for connecting said unit case to a mating connector, said connector portion being sealable against external air when coupled to said mating connector, a connection portion connecting said unit case portion and said connector portion, conductor means embedded as inserts during molding and extending to connect an interior of said unit case portion with said connector portion, said unit case portion having holes through which said conductor means are exposed and which are formed by holding means used to hold said conductor means in position during molding, said connection portion having no such holes grooves are provided at opposite sides of said unit case portion for receipt therein of means for sealing said unit case portion against external air, and a hollow space located above said connection portion and separating said unit case portion from said connector portion so that terminals at an end of said connector portion are easily accessible for connection to said mating connector; and said mold including preliminary holding means for holding conductor means in place before resin is introduced into dies of said mold, said holding means being retracted while said resin is being introduced into said dies to release a hold of said conductor means.

* * * * *